US006354336B1

(12) United States Patent
Leban

(10) Patent No.: US 6,354,336 B1
(45) Date of Patent: Mar. 12, 2002

(54) AUTOMATIC CABLE TIE TOOL HAVING A FRONT JAW LOCKING MECHANISM

(75) Inventor: Joseph F. Leban, Warrenville, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 09/685,491

(22) Filed: Oct. 10, 2000

Related U.S. Application Data

(60) Provisional application No. 60/158,811, filed on Oct. 12, 1999.

(51) Int. Cl.[7] ..... B21F 9/02

(52) U.S. Cl. ..... 140/93.2; 140/123.6

(58) Field of Search ..... 140/93 A, 93.2, 140/123.6, 119

(56) References Cited

U.S. PATENT DOCUMENTS

| | | | |
|---|---|---|---|
| 3,946,769 | A | 3/1976 | Caveney et al. |
| 4,178,973 | A | 12/1979 | Collier et al. |
| 4,357,969 | A | 11/1982 | Peterpaul |
| 4,495,972 | A | 1/1985 | Walker |
| 4,498,506 | A | 2/1985 | Moody et al. |
| 4,534,817 | A | 8/1985 | O'Sullivan |
| 4,790,225 | A | 12/1988 | Moody et al. |
| 4,862,928 | A | 9/1989 | Caveney et al. |
| 5,042,535 | A | 8/1991 | Moody et al. |
| 5,050,649 | A | 9/1991 | Kurmis |
| 5,205,328 | A | 4/1993 | Johnson et al. |
| 5,595,220 | A | 1/1997 | Leban et al. |
| 5,722,466 | A | 3/1998 | Levin et al. |
| 5,845,681 | A | 12/1998 | Kurmis |

*Primary Examiner*—Lowell A. Larson
(74) *Attorney, Agent, or Firm*—Robert A. McCann; Jay A. Saltzman

(57) ABSTRACT

A cable tie application tool for applying cable ties about respective bundles. The tool applies the cable ties one at a time such that the tool performs one complete application cycle to apply each of the cable ties. The cable tie application tool includes a tool frame, a rotatable front jaw extending from a front portion of the tool frame, a rotatable bottom jaw extending from a bottom portion of the tool frame, and a front jaw locking mechanism for preventing the front jaw from being significantly rotated during at least one preselected period of the application cycle of the tool. This prevents the misalignment of cable ties during the application cycles and tool jams resulting therefrom. The bottom jaw cooperates with the front jaw during a portion of the application cycle to substantially encircle the bundle and facilitate the cable tie being applied thereabout.

11 Claims, 8 Drawing Sheets

AUTOMATIC CABLE TIE TOOL HAVING A FRONT JAW LOCKING MECHANISM

This application claims priority to and incorporates by reference U.S Provisional Patent Application No. 60/158, 811, filed Oct. 12, 1999.

TECHNICAL FIELD

The present invention relates generally to automatic cable tie application tools and more particularly to a cable tie application tool having a front jaw locking mechanism which locks the front jaw prior to application of the cable tie to prevent misfeeds.

BACKGROUND OF THE INVENTION

Automatic cable tie application tools for applying discrete cable ties around bundles of wires or the like are well known and commonly used in situations where a high volume of cable ties are intended to be applied. U.S. Pat. Nos. 4,498, 506 to Moody et al. and 5,722,466 to Levin et al. disclose general features of automatic cable tie application tools. Automatic cable tie application tools of this type generally include a dispenser mechanism, a conveyance mechanism and a remote tool. The dispenser mechanism accepts a plurality of cable ties and sequentially dispenses individual ties to the conveyance mechanism. The conveyance mechanism delivers the individual tie to the remote tool. The remote tool includes application means that positions each tie around a bundle or the like, tensions the tie to a predetermined value and then severs the tail of the tie. The ability for these cable tie tool systems to consistently and correctly apply cable ties around the intended bundles is very important.

The application means of the remote tool generally includes a pair of tool jaws which guide the cable tie to be locked around the bundle. The tool jaws are generally moveable in order to facilitate threading and tightening of the cable tie around the bundle. In applications where the user has limited room for positioning of the front of the tool due to working in a crowded location, the front jaw can be prematurely, partially closed such that advancement of the cable tie to the tool jaws results in a misfeed. Thus, there is need for improvement in cable tie application tools.

DESCRIPTION OF THE PREFERRED EMBODIMENT

Figure 1:
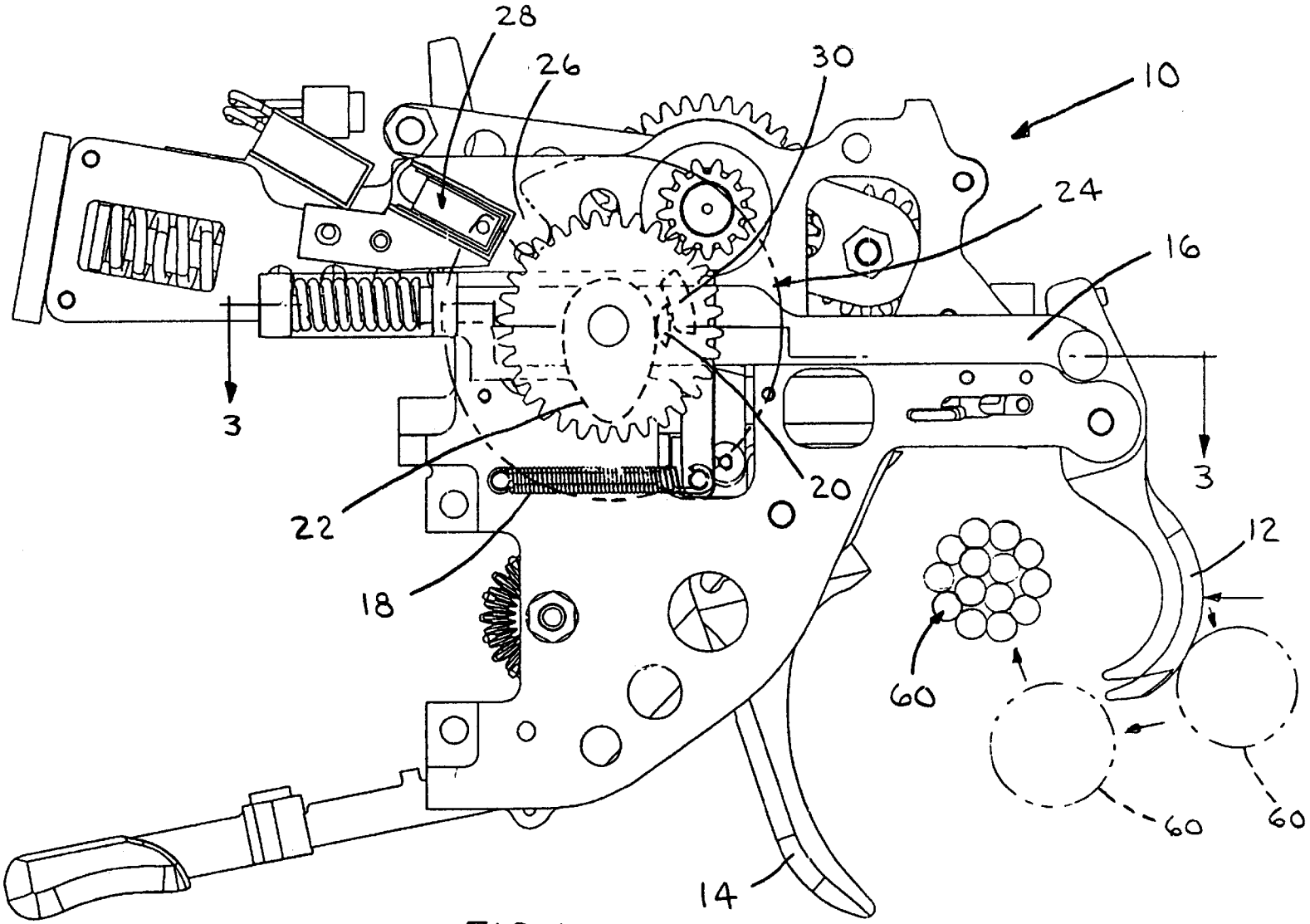
FIG. 1 is a side elevational view of the front end of the remote tool including the locking mechanism of the tool in accordance with the proposed invention shown with the housing removed and being positioned around a bundle.
Figure 2:
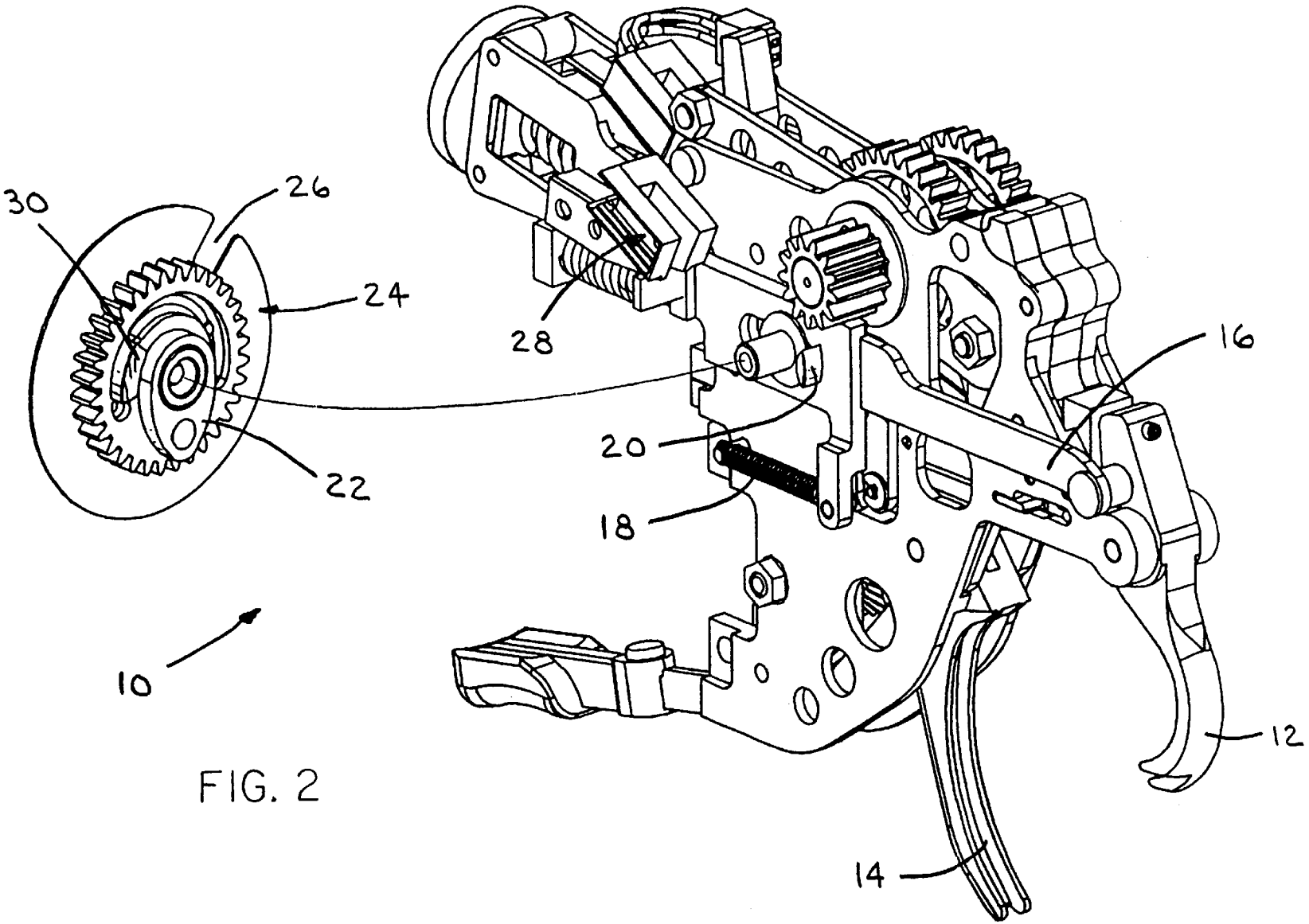
FIG. 2 is a front perspective view of the front end of the remote tool shown in FIG. 1.
Figure 3:
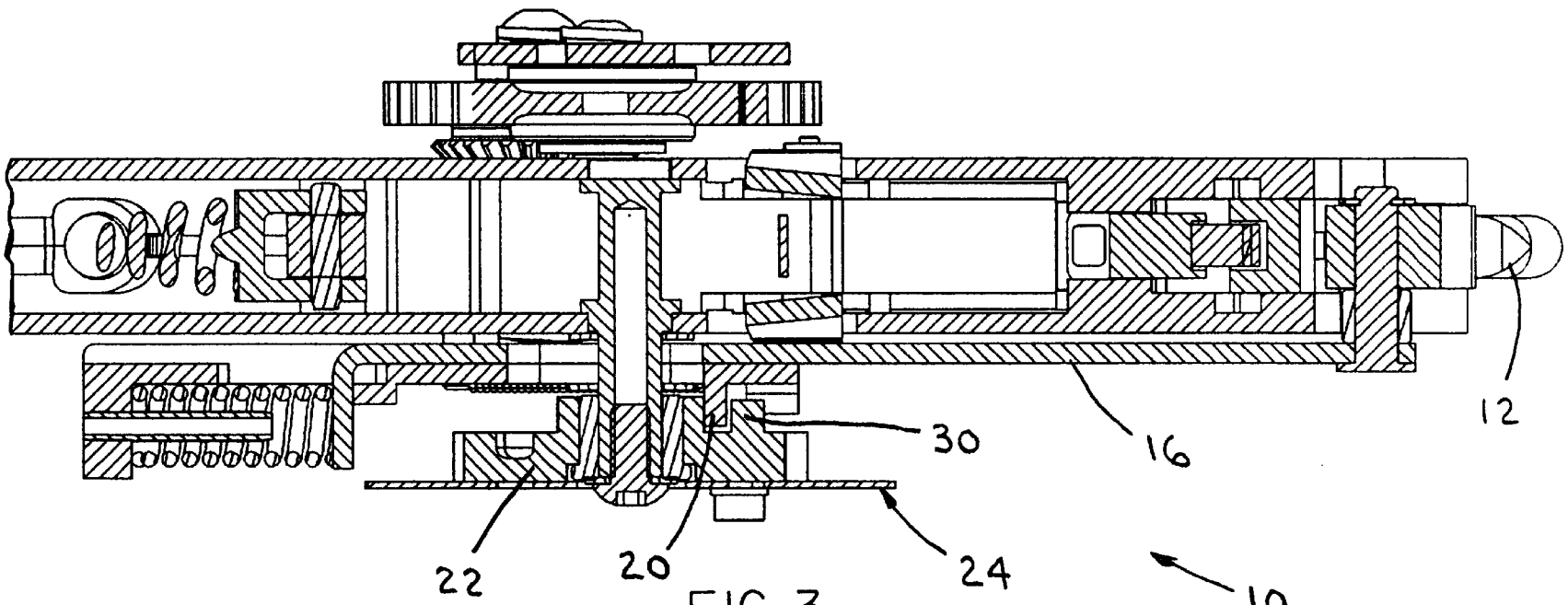
FIG. 3 is a cross-sectional view taken along lines 3—3 of FIG. 1.
Figure 4:
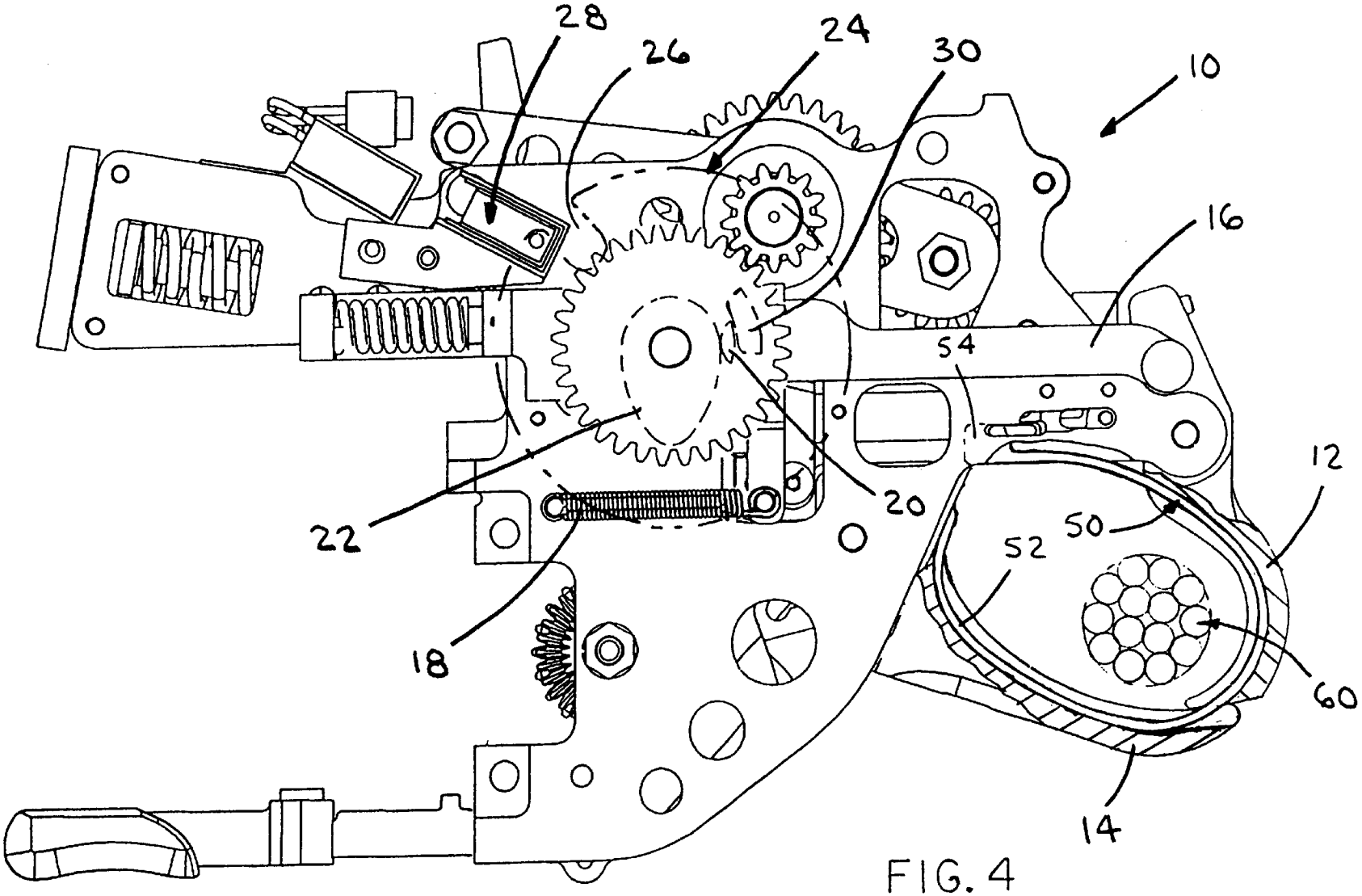
FIG. 4 is a side elevational view of the front end of the remote tool shown in the initial cycle position.
Figure 5:
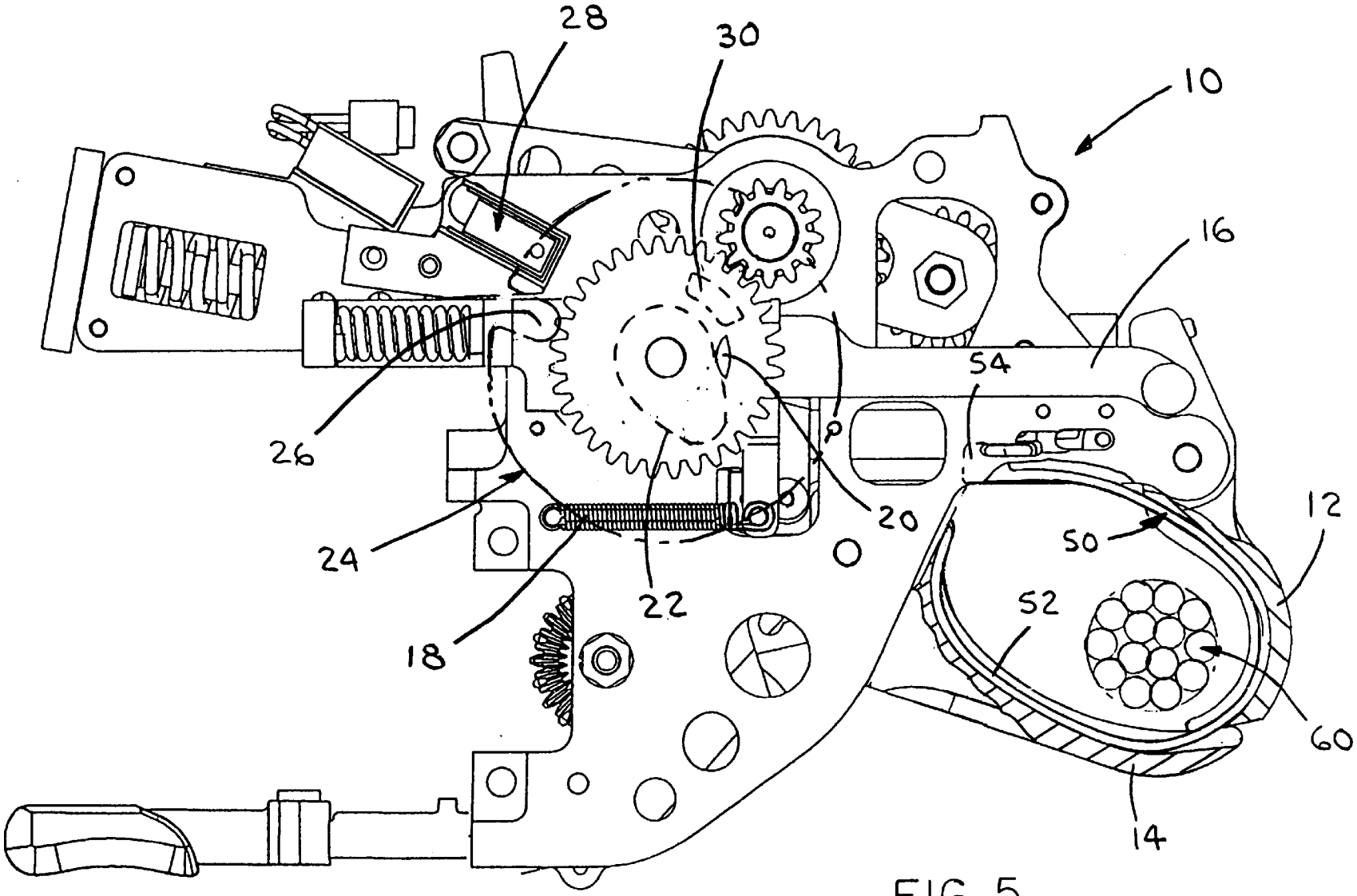
FIG. 5 is a side elevational view of the front end of the remote tool shown in a front jaw lock release position.
Figure 6:
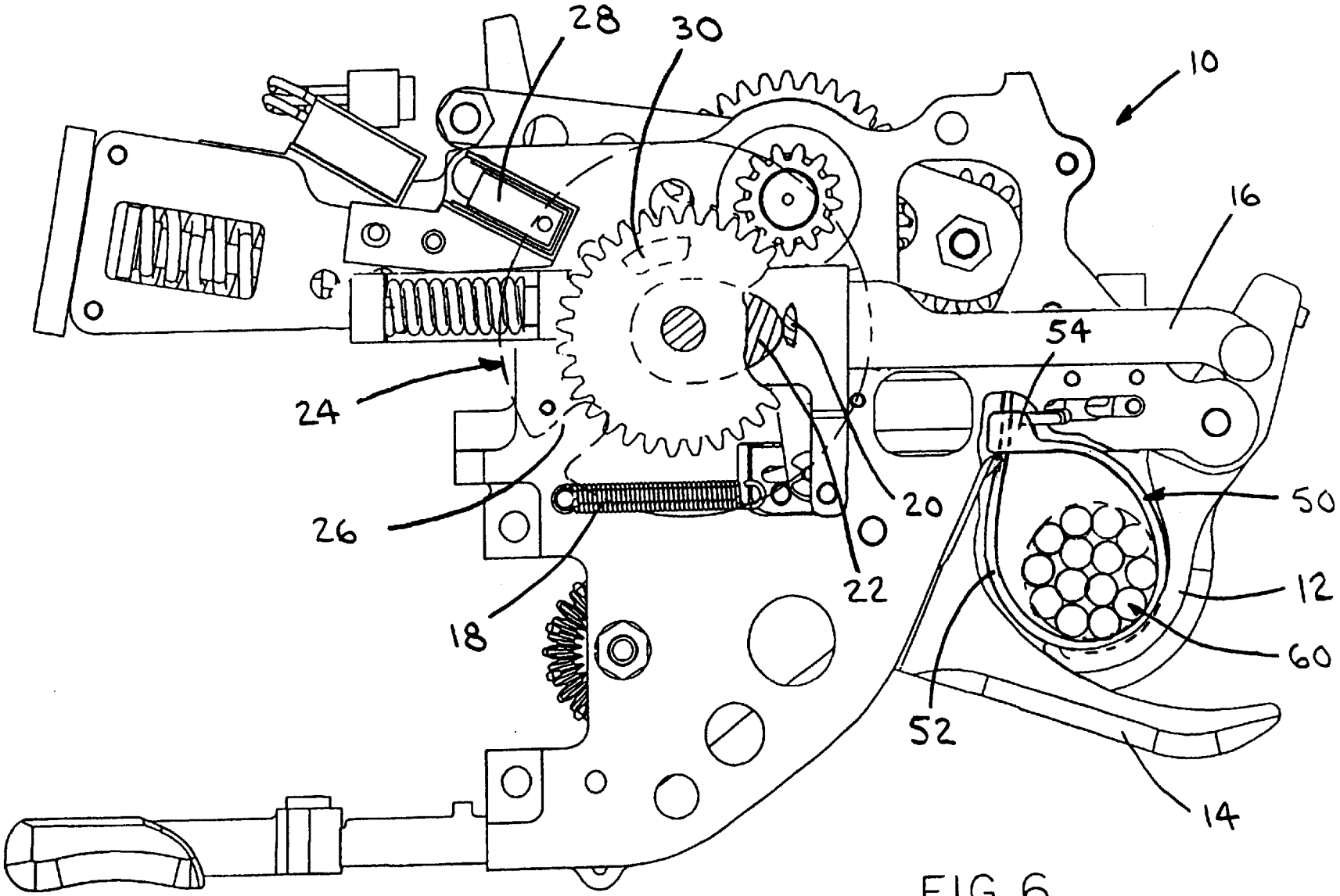
FIG. 6 is a side elevational view of the front end of the remote tool shown in the tie threading position.
Figure 7:
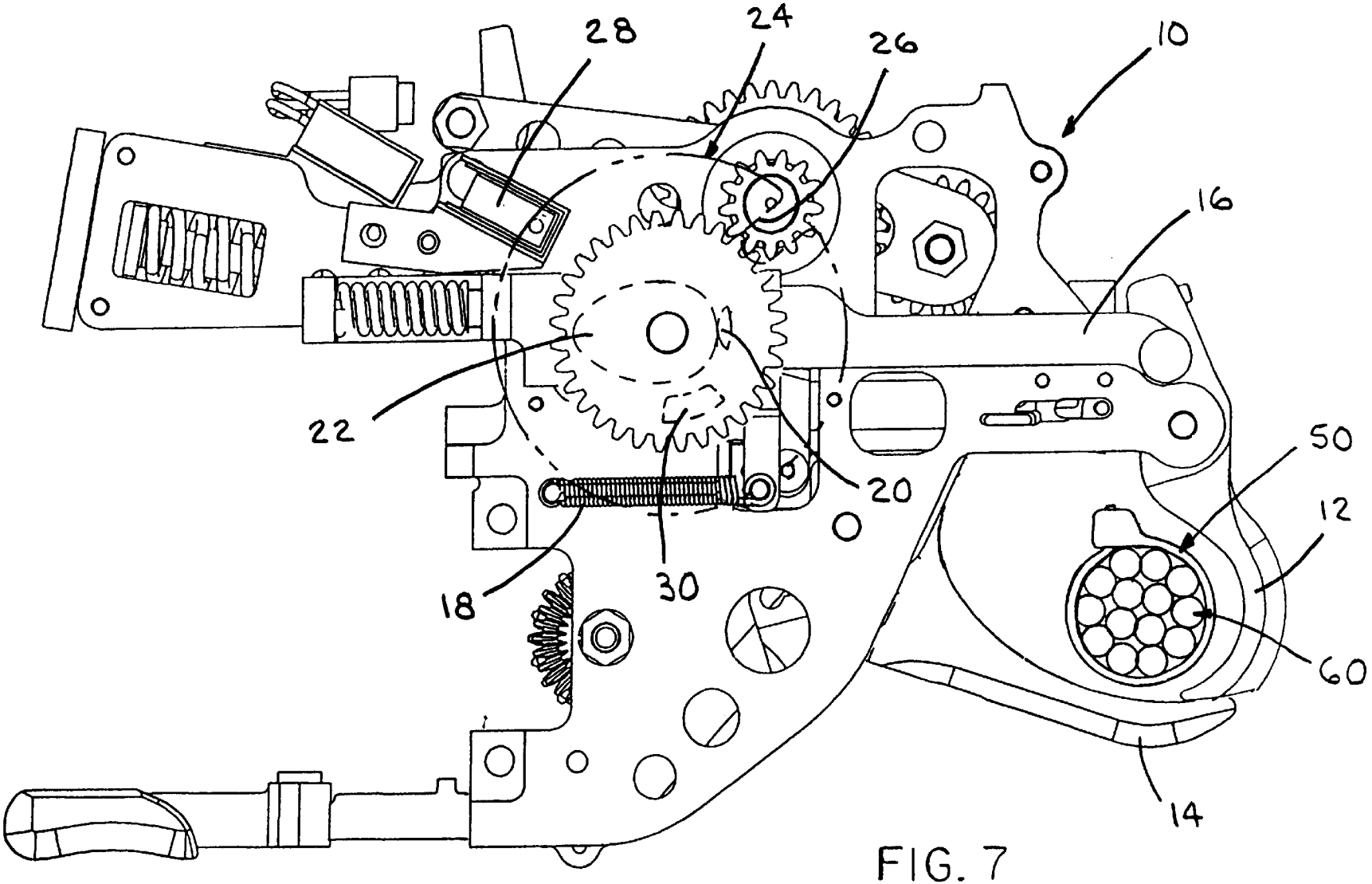
FIG. 7 is a side elevational view of the front end of the remote tool shown in the tie/bundle release position.

FIG. 1 shows the front end of the remote tool 10 including the cable tie positioning and tightening mechanisms of the tool. Positioning and tightening of the tie is accomplished with assistance of the operation of a frontjaw 12 and a lower jaw 14. As can be seen in FIGS. 1, 2 and 4, together the front and lower jaw 12, 14 have a continuous inner circumferential guide track that accepts the strap of a cable tie 50 as it is moved into position and directs the strap 52 around a bundle 60 towards the locking head 54 of tie. The front jaw is connected to a front jaw link assembly 16 which is further connected to a spring 18 which biases the front jaw in its initial open position. After the tool jaws are positioned around a bundle, the trigger can be pulled which closes the lower jaw adjacent to the front jaw to encircle the bundle. Thus, upon further actuation of the tool cycle, the tie is conveyed into position around the bundle with the strap end positioned adjacent the head of the cable tie as shown in FIG. 4.

The standard operation of the threading and tightening of the cable tie can best be described with reference to FIGS. 4–7. As can be seen in FIG. 4, the front jaw link assembly includes a cam follower 20 which upon continuation of the tool cycle is acted upon by a cam 22 which forces the front jaw link assembly 16 forward causing the front jaw 12 to pivot inwardly. The closing of the frontjaw threads the strap body 52 through an opening in the cable tie head 54. The strap body is subsequently engaged by a gripper (not shown) of the tensioning mechanism for complete tensioning around the bundle. After the cable tie has been fully tightened to the predetermined tension, a severing mechanism cuts off the excess portion of the strap which has been threaded through the locking head.

Figure 8:
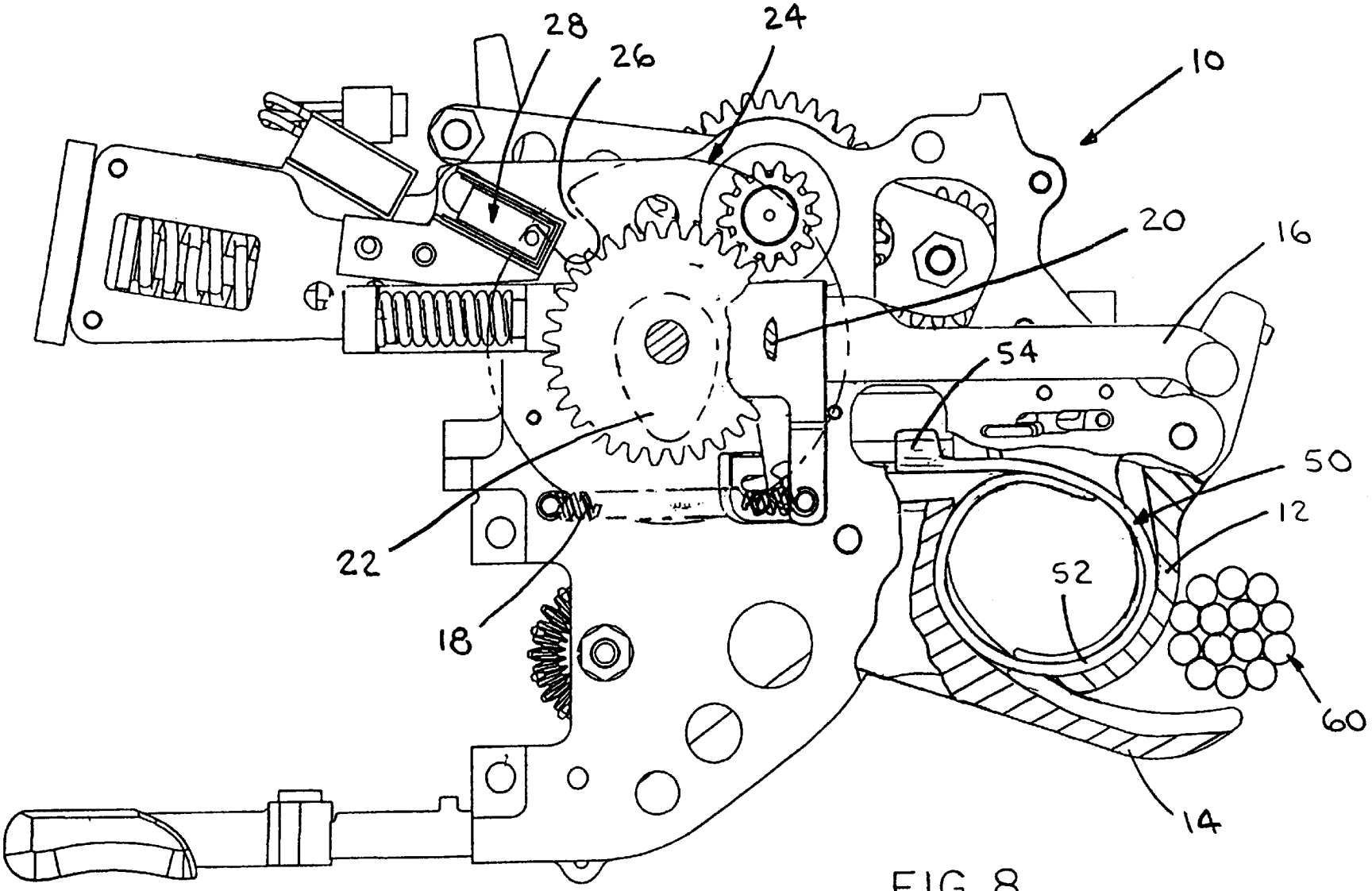
FIG. 8 is a side elevational view of a prior art tool showing a misfeed caused by the front jaw prematurely closing.

FIG. 8 shows a tie which has been conveyed into the tool jaw position that has resulted in a misfeed because the tool does not include a front jaw locking mechanism. As can be seen, without a front jaw locking mechanism, the front jaw can be pushed inwardly by a nearby bundle or any other object in the working area. Thus, when the cable tie is conveyed to the jaw area the strap is misaligned with the locking head and a misfeed results.

As can be seen in FIGS. 4–7, the cam 22 is mounted on a shaft and is interconnected by a gear train to a controlling motor. Also provided on the cam shaft assembly is a sensor disk 24 that rotates simultaneously through the cycle and includes a timing slot 26 that is positioned on the disk such that when the timing slot is identified by the sensor 28 the control motor is told that the cycle is complete. When a cycle is initiated by the motor, the cam and sensor disk rotate in the counterclockwise direction. This rotation continues until the timing slot is aligned with the sensor which tells the motor which stops the cycle.

The operation of the front jaw locking mechanism can best be described with reference to FIGS. 1, 2 and 4–7. As shown in FIG. 2 the cam shaft assembly also includes a front jaw lock 30 disposed on a cam gear and positioned so as to be on the opposite side of the cam follower than the cam. Thus while the cam follower is disposed behind the jaw lock the front jaw link assembly will not move forward and close the front jaw.

As can be seen in FIG. 4, when the tool is in the starting cycle position, the front jaw cam is positioned so that the front jaw is in the initial or open position. In this position, the cam follower is captured between the cam gear and the front jaw lock 30 so that the front jaw is locked for proper application of the cable tie. As the cycle begins the cable tie is accurately positioned within the tool jaws around a bundle such that the strap end is properly positioned so as to be insertable through the strap passageway of the cable tie head. Subsequently, as the cam gear rotates counter clockwise through its cycle, the front jaw stop rotates out of position adjacent the cam follower and thus directs the cam follower to move the front jaw link assembly forward to pivot the front jaws inward. When the application cycle is complete, the front jaw and cam return to the initial position.

The inward movement of the upper jaw drives strap of a tie positioned thereon, upward through head. Thus selective actuation of the jaw cycle results in threading a tie strap into locking engagement with its head. Provided in the tool is a gripper mechanism that draws the strap through head of tie until a predetermined tension is reached and then actuates a knife that cuts the strap adjacent the head of tie.

It should be noted that the above-described and illustrated embodiments of the invention are not an exhaustive listing of the forms a cable tie tool in accordance with the invention could take; rather they serve as exemplary and illustrative of preferred embodiments of the invention as presently understood. Many other forms of the invention are believed to exist.

What is claimed is:

1. A cable tie application tool for applying cable ties about respective bundles, wherein said tool applies said cable ties one at a time such that said tool performs one complete application cycle to apply each of said cable ties, said cable tie application tool comprising:

a tool frame;

a rotatable front jaw extending from a front portion of said tool frame;

a rotatable bottom jaw extending from a bottom portion of said tool frame, said bottom jaw for cooperating with said front jaw during a portion of said application cycle to substantially encircle said bundle and facilitate said cable tie being applied thereabout; and a front jaw locking mechanism for preventing said front jaw from being rotated during at least one preselected period of said application cycle of said tool, thereby preventing misalignment of a cable tie during said application cycle and a tool jam resulting therefrom.

2. A cable tie application tool in accordance with claim 1 wherein said front jaw is normally biased rotationally outwardly and, outside said preselected period of said application cycle, may be rotated inwardly against said bias by contacting one of said bundles, thereby permitting said bundle to pass inwardly of said front jaw so that said front jaw and bottom jaw may cooperatively encircle said bundle.

3. A cable tie application tool in accordance with claim 2 wherein said bias is provided by a spring.

4. A cable tie application tool in accordance with claim 1 wherein said tool further includes a trigger for manually initiating a cable tie application cycle.

5. A cable tie application tool in accordance with claim 4 wherein said application cycle begins by said bottom jaw being rotated to meet said front jaw thereby encircling said one of said bundles.

6. A cable tie application tool in accordance with claim 1 wherein said frontjaw locking mechanism includes a control motor for controlling a cam having an associated cam locking mechanism and a timing disk, wherein said cam is selectively locked and unlocked from rotation during said application cycle depending upon the orientation of said timing disk, said cam being associated with rotation of said front jaw during said application cycle.

7. A cable tie application tool in accordance with claim 6 wherein said timing disk includes a generally radial slot therein and said orientation of said timing disk is determined by a sensor in said tool which evaluates the angular position of said slot.

8. A cable tie application tool in accordance with claim 6 wherein said cam locking mechanism includes a cam follower rotationally linked to said cam and a jaw lock generally fixed relative to said tool frame and said locking mechanism prevents said front jaw from being rotated by providing contact between said cam follower and said jaw lock.

9. A cable tie application tool in accordance with claim 6 wherein said tool further includes a tensioner for controlling said application of said cable tie such that said tie is tightened around said bundle until a predetermined level of tension is felt by said tie.

10. A cable tie application tool in accordance with claim 6 wherein said tool further includes a severing tool for severing an excess portion of said cable tie after it has been applied to said bundle.

11. A cable tie application tool for applying cable ties about respective bundles, wherein said tool applies said cable ties one at a time such that said tool performs one complete application cycle to apply each of said cable ties, said cable tie application tool comprising:

a tool frame;

a rotatable front jaw extending from a front portion of said tool frame;

a rotatable bottom jaw extending from a bottom portion of said tool frame, said bottom jaw for cooperating with said front jaw during a portion of said application cycle to substantially encircle said bundle and facilitate said cable tie being applied thereabout; and front jaw locking means for preventing said front jaw from being rotated during at least one preselected period of said application cycle of said tool, thereby preventing misalignment of a cable tie during said application cycle and a tool jam resulting therefrom.

* * * * *